US005995789A

United States Patent [19]

Murakami et al.

[11] Patent Number: 5,995,789

[45] Date of Patent: Nov. 30, 1999

[54] TONER CARTRIDGE INCLUDING TONER OUTLET OPENINGS AND TONER COLLECTION OPENINGS ARRANGED SUBSTANTIALLY IN A SINGLE ARRAY

[75] Inventors: Eisaku Murakami, Hiratsuka; Hiroshi Saitoh, Ayase, both of Japan

[73] Assignee: Ricoh Company, Ltd., Tokyo, Japan

[21] Appl. No.: 09/015,290

[22] Filed: Jan. 29, 1998

Related U.S. Application Data

[63] Continuation of application No. 08/602,043, Feb. 15, 1996.

[30] Foreign Application Priority Data

| | | | |
|---|---|---|---|
| Mar. 23, 1995 | [JP] | Japan | 7-098156 |
| Apr. 28, 1995 | [JP] | Japan | 7-0106516 |
| Feb. 16, 1998 | [JP] | Japan | 7-028074 |

[51] Int. Cl.[6] ..... G03G 15/08

[52] U.S. Cl. ..... 399/262; 222/DIG. 1; 399/263

[58] Field of Search ..... 399/253–256, 399/258–260, 262, 263, 120; 222/DIG. 1

[56] References Cited

U.S. PATENT DOCUMENTS

| | | | |
|---|---|---|---|
| 5,384,629 | 1/1995 | Watanabe et al. | 399/120 |
| 5,581,337 | 12/1996 | Suzuki | 399/262 |
| 5,835,822 | 11/1998 | Nagasaki et al. | 399/120 |

*Primary Examiner*—William Royer
*Attorney, Agent, or Firm*—Oblon, Spivak, McClelland, Maier & Neustadt, P.C.

[57] ABSTRACT

A toner cartridge removably mounted to an image forming apparatus including a developing device. The toner cartridge includes a plurality of toner outlet openings for replenishing toner to the developing device and a plurality of toner collection openings for collecting the toner from the developing device. Further, the plurality of toner outlet openings and the plurality of toner collection openings are arranged substantially in a single array.

63 Claims, 9 Drawing Sheets

TONER CARTRIDGE INCLUDING TONER OUTLET OPENINGS AND TONER COLLECTION OPENINGS ARRANGED SUBSTANTIALLY IN A SINGLE ARRAY

This application is a Continuation of application Ser. No. 08/602,043, filed on Feb. 15, 1996.

BACKGROUND OF THE INVENTION

The present invention relates to a developing device for an electrophotographic image forming apparatus, and a toner cartridge for replenishing a fresh toner to the developing device.

A copier, facsimile apparatus, laser printer or similar electrophotographic image forming apparatus has a developing device for developing a latent image electrostatically formed on a photoconductive element, or image carrier, by using a toner. It has been customary with this kind of apparatus to replenish a fresh toner into the developing device from a toner cartridge removably mounted to the developing device. The developing device includes a toner storing section or hopper for receiving the fresh toner from the cartridge. During the course of development, the toner is sequentially fed from the hopper to the photoconductive element. The toner consists of toner particles and an additive. The problem with the conventional developing device is that as the developing device is operated a number of times, the additive concentration of the toner increases. As a result, the toner density, i.e., the density of an image developed by the toner is lowered. Specifically, although the additive should ideally be transferred to the latent image of the photoconductive element together with the toner particles, the additive is, in practice, left in the hopper without being consumed. Moreover, assume that the developing device or the entire image forming apparatus is held in an inclined position by accident. Then, because the toner is fed over the entire length of the photoconductive element, the additive concentrates on one end portion lower in level than the other end portion. This further increases the additive concentration of the toner and thereby aggravates the decrease in toner density or image density.

SUMMARY OF THE INVENTION

It is therefore an object of the present invention to provide a developing device for an image forming apparatus that is capable of preventing the toner density from decreasing, and a toner cartridge therefor.

In accordance with the present invention, a toner cartridge removably mounted to an image forming apparatus including a developing device has a plurality of toner outlet openings for replenishing toner to the developing device, and a plurality of toner collection openings for collecting the toner from the developing device. In addition, the plurality of toner outlet openings and the plurality of toner collection openings are arranged substantially in a single array. Further included is a magnetic roller facing the plurality of toner outlet openings and the plurality of toner collection openings, in which the magnetic roller attracts and circulates the toner.

Also, in accordance with the present invention, the toner cartridge includes a protruding portion for scraping off the toner deposited on the magnetic roller into the plurality of toner outlet openings, and a blade for scraping off the toner collected from the developing device via the plurality of toner collection openings and deposited on the magnetic roller into the toner cartridge. Further, the blade contacts a portion of the magnetic roller facing the plurality of toner collection openings, and the protruding portion faces a portion of the magnetic roller not contacting the blade.

In addition, in accordance with the present invention, a toner cartridge removably mounted to an image forming apparatus including a developing device, includes means for replenishing toner to the developing device, means for collecting the toner from the developing device, and magnetic roller means for attracting and circulating the toner, in which the toner attracting and circulating means faces the toner replenishing means and the toner collecting means. Also included is first scraping means for scraping off toner deposited on the toner attracting and circulating means into the toner replenishing means, and second scraping means for scraping toner collected from the developing device via the toner replenishing means and deposited on the toner attracting and circulating means into the toner cartridge.

Also, in accordance with the present invention, a method for conveying toner from a toner cartridge removably mounted to an image forming apparatus including a developing device, includes the steps of replenishing toner to the developing device by a plurality of toner outlet openings, and collecting the toner from the developing device by a plurality of toner collection openings. In addition, the step of replenishing includes replenishing toner by the plurality of toner outlet openings, the plurality of toner outlet openings being arranged substantially in a single array with the plurality of toner collection openings. The method also includes the step of attracting and circulating the toner by a magnetic roller facing the plurality of toner outlet openings and the plurality of toner collection openings.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
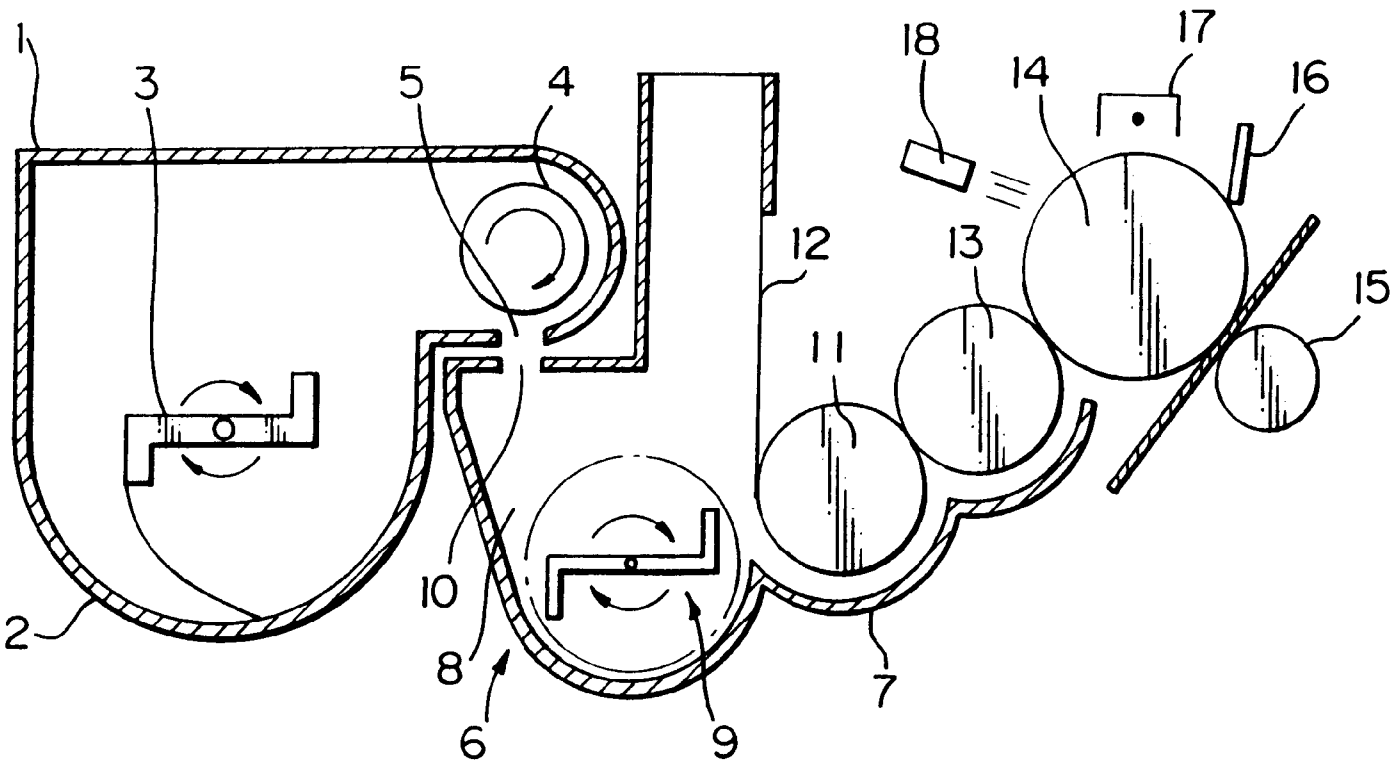
Fig. 1 PRIOR ART
FIG. 1 is a section of a conventional developing device operable with a toner cartridge.
Figure 2:
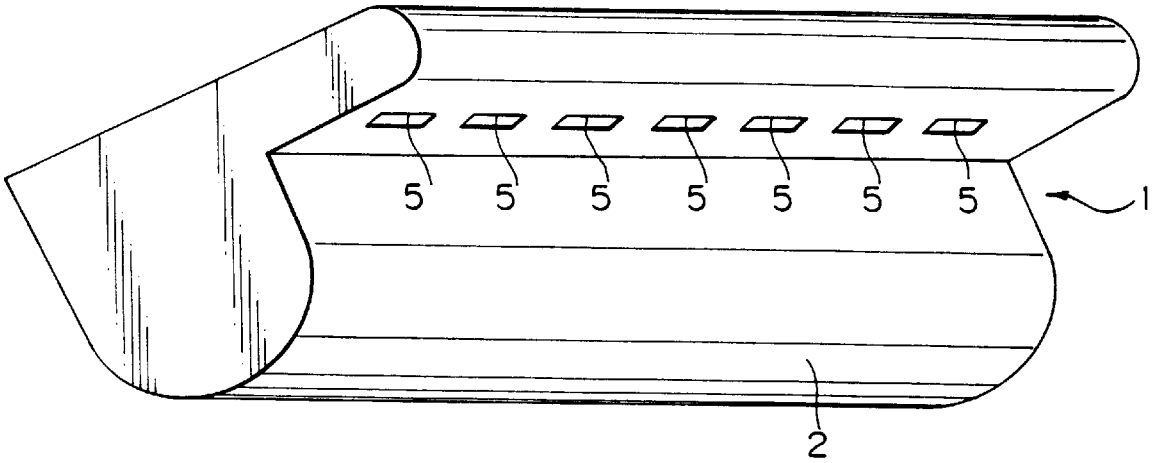
Fig. 2 PRIOR ART
FIG. 2 is an external perspective view of the toner cartridge shown in FIG. 1.

To better understand the present invention, a brief reference will be made to a conventional developing device using a toner cartridge, shown in FIG. 1. As shown, a toner cartridge 1 stores a fresh single-ingredient type toner therein. The cartridge 1 has a casing 2 accommodating an agitator 3 and a magnetic roller 4. The agitator 3 is rotated to agitate the toner existing in the casing 2. The casing 2 is formed with a plurality of toner outlets 5. As shown in FIG. 2, the toner outlets 5 are arranged in an array in the lengthwise direction of the casing 2.

A developing device 6 has a casing 7 including a toner storing section, or hopper as referred to hereinafter, 8. An agitator 9 is rotatable in the hopper 8 for agitating the toner existing in the hopper 8. A toner inlet 10 is formed in a portion of the casing 7 which faces the toner outlets 5 of the cartridge casing 2. A developing roller 11 causes the toner to deposit thereon. A doctor blade 12 causes the toner to form a thin layer on the surface of the developing roller 11. An intermediate roller 13 is held in contact with the developing roller 11, so that the toner is transferred from the roller 11 to the roller 13. A photoconductive element in the from of a drum 14 is held in contact with the intermediate roller 13.

The toner is transferred from the roller 13 to the drum 14 in order to develop a latent image electrostatically formed on the drum 14. The resulting toner image is transferred from the drum 14 to a paper or similar recording medium by an image transfer unit 15. A cleaning unit 16 cleans the surface of the drum 14 after the image transfer. A charger 17 uniformly charges the surface of the drum 14. An exposing device 18 exposes the charged surface of the drum 14 imagewise so as to form the latent image.

The toner in the hopper 8 is conveyed toward the developing roller 11 while being agitated by the agitator 9. The toner deposited on the roller 11 is regulated by the doctor blade 12 to form a thin layer, while being frictionally charged thereby. As a result, the toner is electrically transferred from the roller 11 to the intermediate roller 13. On the other hand, the drum 14 is uniformly charged by the charger 17. The exposing device 18 electrostatically forms a latent image on the charged surface of the drum 14. When the latent image is conveyed by the drum 14 to a position where the drum 14 contacts the roller 13, the toner is transferred from the roller 13 to the latent image. The resulting toner image is transferred to the paper by the image transfer unit 15.

The magnetic roller 4 disposed in the cartridge 1 serves to replenish the fresh toner into the developing device 6. Hence, to insure stable replenishment into the hopper 8, it is preferable to use means for scraping off the toner from the surface of the roller 4, as will be described with reference to FIG. 3.

Figure 3:
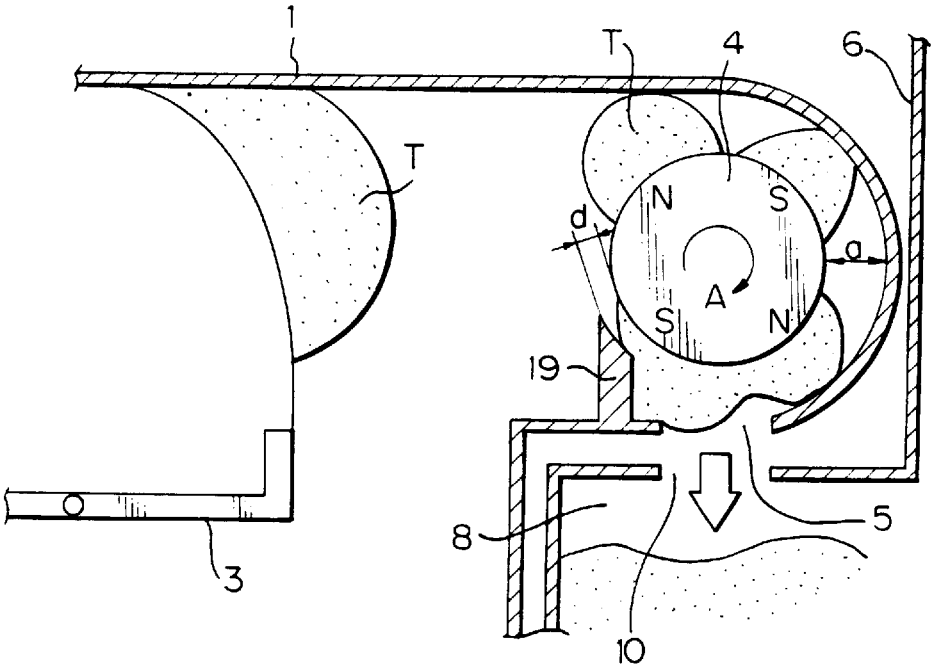
Fig. 3 PRIOR ART
FIG. 3 is a section showing an arrangement around a magnetic roller disposed in the toner cartridge shown in FIG. 2.

FIG. 3 shows an arrangement around the magnetic roller 4. As shown, an upright rib 19 extends in the lengthwise direction of the toner outlets 5 from the downstream edges of the outlets 5 with respect to the direction of toner conveyance. The edge of the rib 19 and the roller 4 are spaced from each other by a gap d. The agitator 3 rotating in the cartridge 1 conveys the toner, labeled T, to the roller 4. The toner deposited on the roller 4 is conveyed toward the toner outlets by the roller 4 which is rotated in a direction A. Specifically, the toner T is deposited on the roller 4 over a clearance a between the roller 4 and the inner periphery of the cartridge casing 2. Because the gap d is selected to be smaller than the clearance a, the toner T deposited on the roller 4 is scraped off by the rib 19 and introduced into the hopper 8.

Figure 4:
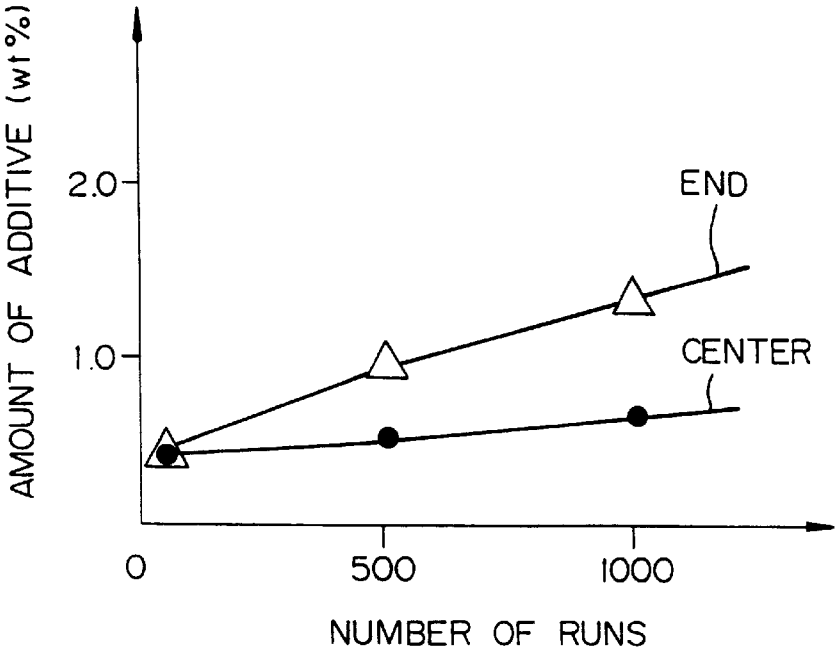
Fig. 4 PRIOR ART
FIG. 4 is a graph showing a relation between the number of runs of the developing device and the amount of an additive existing in a hopper included in the device.
Figure 5:
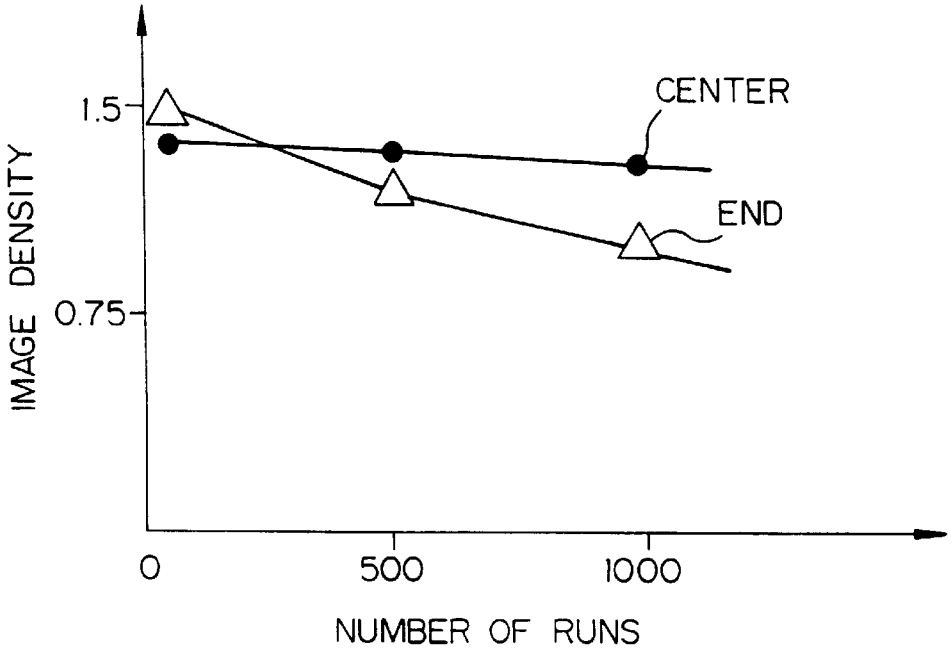
Fig. 5 PRIOR ART
FIG. 5 is a graph showing a relation between the number of runs of the developing device and the image density.

In the above configuration, the toner T is stably replenished from the cartridge 1 into the hopper 8 at all times. However, in the hopper 8, the concentration of an additive included in the toner sequentially increases with an increase in the number of runs of the developing device 6. As a result, the image density is lowered. Particularly, as shown in FIG. 4, the additive concentration of the toner noticeably increases at the end portions of the developing device 6, compared to the intermediate portion of the same. FIG. 5 shows the resulting decrease in image density.

Preferred embodiments of the present invention will be described hereinafter which are free from the problem discussed above. In the embodiments, the same or similar constituents as or to the constituents shown in FIGS. 1–3 are designated by the same reference numerals, and a detailed description thereof will not be made in order to avoid redundancy.

Figure 6:
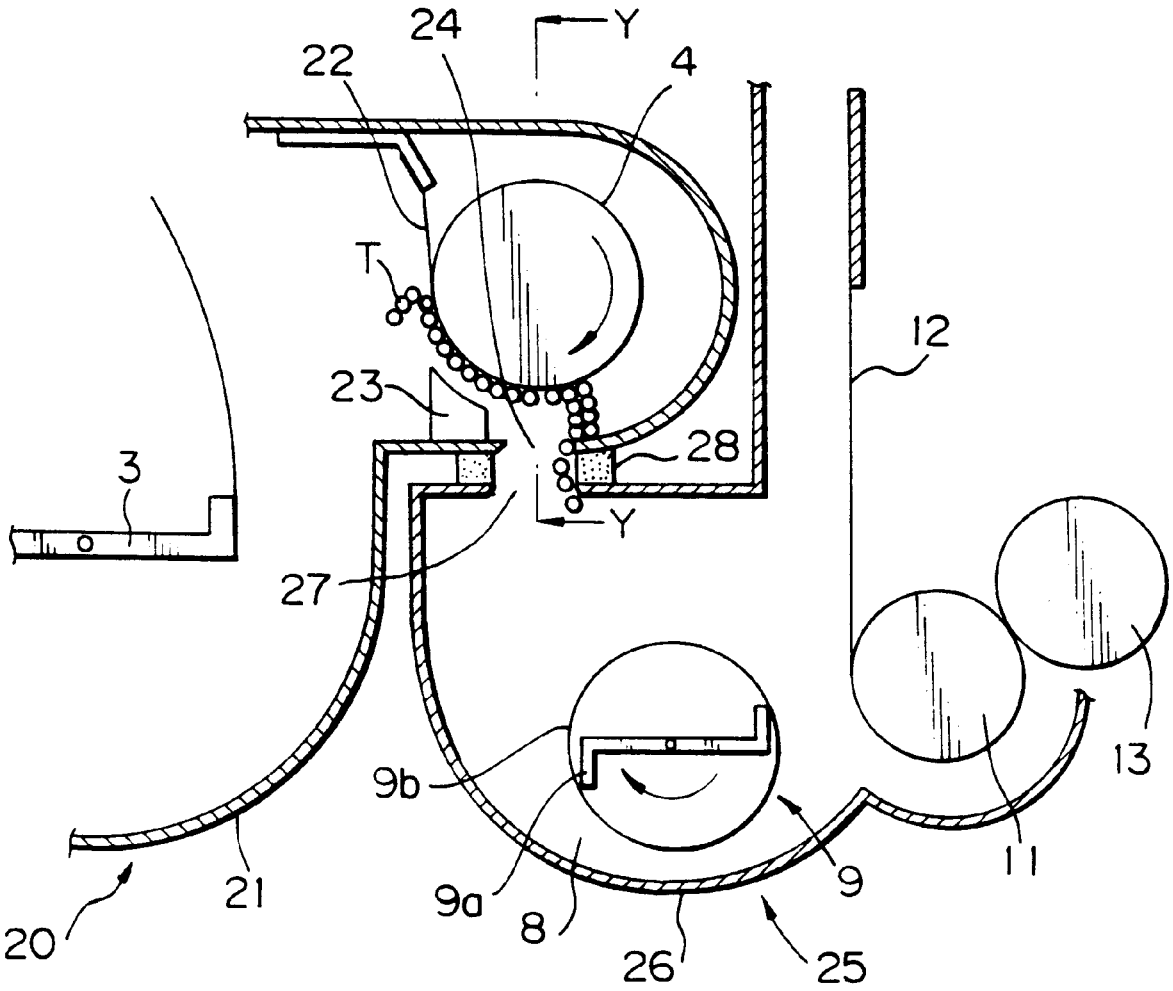
FIG. 6 is a fragmentary section of a developing device embodying the present invention and operable with a toner cartridge.

FIG. 6 shows a developing device embodying the present invention. As shown, a toner cartridge 20 has a casing 21. A blade 22 contacts the surface of a magnetic roller 4 and is made of polyethylene terephthalate (PET). Upright ribs 23 (i.e. protruding portions) respectively extend from the casing 21 at both sides of the blade 22, and each faces the surface of the roller 4. The ribs 23 are equivalent in function to the rib 19 shown in FIG. 3.

The edge of the blade 22 is oriented counter to the direction of rotation of the roller 4 and located downstream of the ribs 23 with respect to the direction of rotation of the roller 4. Collection openings 24 are formed in the casing 21, and each is flared from the inside to the outside of the casing 21.

A developing device 25 has a casing 26 formed with toner outlets 27 respectively facing the collection openings 24 of the casing 26. The toner outlets 27 are flared from the outside to the inside of the casing 26. A sponge 28 is affixed to the outer periphery of the casing 26 in such a manner as to surround the toner outlets 27 and toner inlets which will be described.

Figure 7:
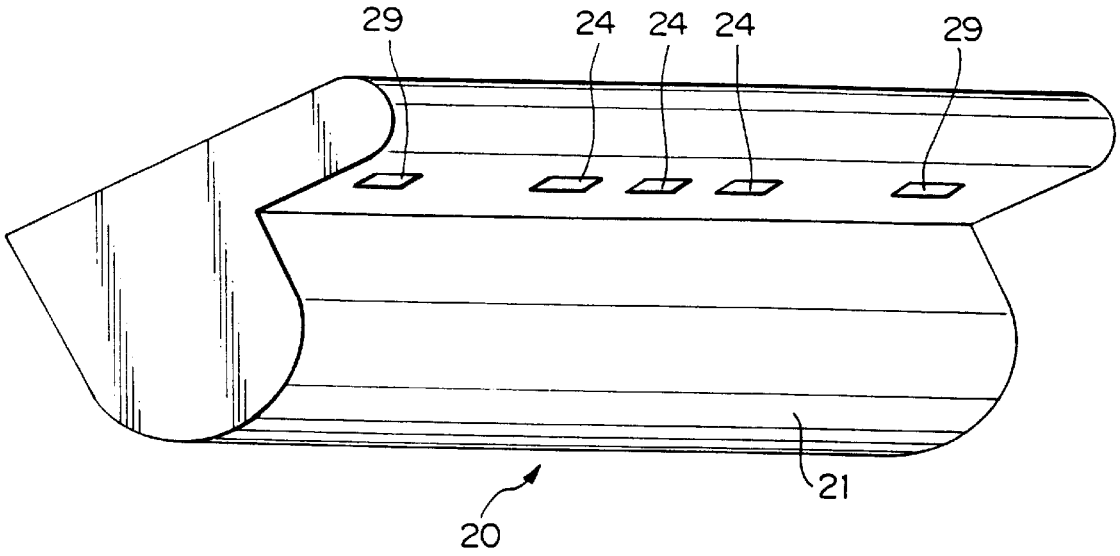
FIG. 7 is an external perspective view of the toner cartridge shown in FIG. 6.

FIG. 7 shows the toner cartridge 20 in an external perspective view. As shown, the casing 21 is formed with toner outlets 29 for replenishing a fresh toner into the developing device 25. Specifically, the toner outlets 29 are located at opposite ends of the surface of the casing 21 that faces the developing device 25 (see FIG. 6) in the lengthwise direction. The previously mentioned collection openings 24 (three in the embodiment) are formed in the intermediate portion of the above surface of the casing 21. Hence, five openings in total are formed in an array in the casing 21.

Figure 8:
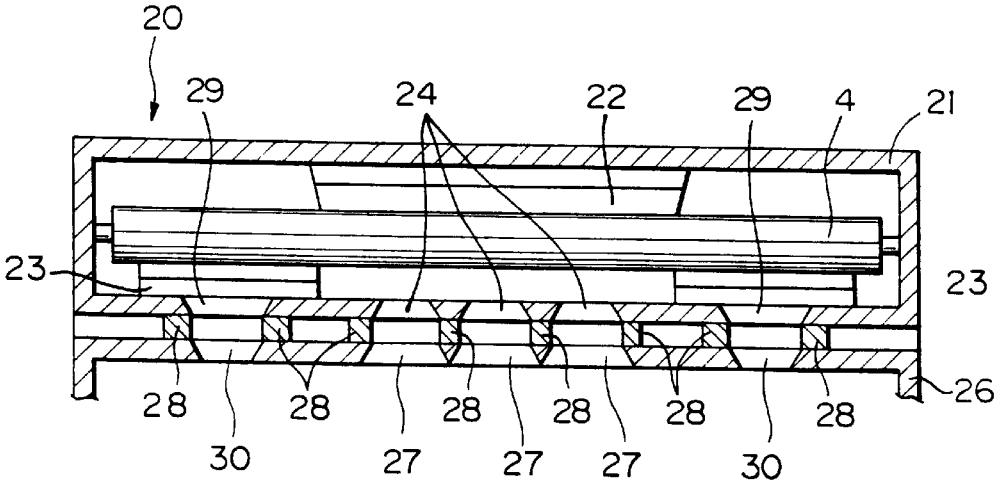
FIG. 8 is a section along line Y—Y of FIG. 6.

FIG. 8 is a section along line Y—Y of FIG. 6. As shown, toner inlets 30 are formed in the casing 26 of the developing device 25 and respectively face the toner outlets 29 of the casing 21. The toner inlets 30 are each flared from the inside to the outside of the casing 26. Specifically, two toner inlets 30 are formed in opposite end portions of the casing 26 and respectively face the toner outlets 29 of the casing 21. Three toner outlets 27 are formed in the intermediate portion of the casing 26 and respectively face the collection openings 24 of the casing 21. Hence, five openings in total are also formed in an array in the casing 26.

When the cartridge 20 is mounted to the developing device 25, the sponge 28 contacts the edge portions of the toner outlets 29 and collection openings 24 and thereby fills the gaps between the edge portions of the toner outlets 29 and the toner inlets 30 and the gaps between the edge portions of the collection openings 24 and the toner outlets 27. The walls of the toner outlets 29 and those of the toner inlets 30 smoothly merge into each other without any step. Likewise, the walls of the collection openings 24 and those of the toner outlets 27 smoothly merge into each other without any step.

The ribs 23 extend from the casing 21 at the downstream side of the toner outlets 29 with respect to the direction of rotation of the roller 4 and such that their edges adjoin the opposite ends of the roller 4. Hence, a space is formed by the ribs 23, roller 4 and casing 21 at the intermediate portion of the roller 4 at the downstream side of the three collection openings 24 with respect to the direction of rotation of the roller 4.

In operation, the agitator 3 in rotation conveys the toner T to the magnetic roller 4. Because the intermediate portion of the roller 4 is covered with the blade 22, the toner T deposits on the opposite end portions of the roller 4. While the roller 4 in rotation conveys the toner T deposited on its opposite end portions, the ribs 23 scrape it off. As a result, the toner T is introduced into the hopper 8 via the aligned toner outlets 29 and toner inlets 30. The toner T is sequentially transferred to a photoconductive element, not shown, by way of an agitator 9, a developing roller 11, and an intermediate roller 13.

The agitator 9 in rotation conveys the toner upward within the hopper 8. As a result, this toner is partly collected in the cartridge 20 via the aligned toner outlets 27 and collection openings 24. Then, the toner is deposited on the roller 4, conveyed by the roller 4, and then scraped off by the blade 22 into the cartridge 20. Although the toner tends to penetrate into the collection opening side 4, such a toner is caught and conveyed by the roller 4 together with the toner collected from the hopper 8, and then scraped off by the blade 22. In this manner, the toner is circulated between the hopper 8 and the cartridge 20.

Figure 9:
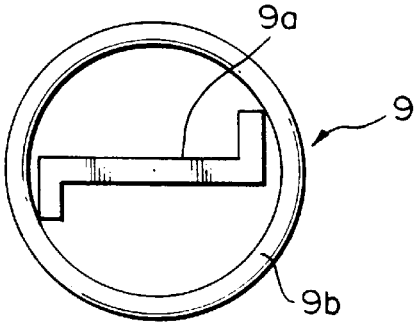
FIG. 9 is a fragmentary side elevation of an agitator representative of an alternative embodiment of the present invention.
Figure 10:
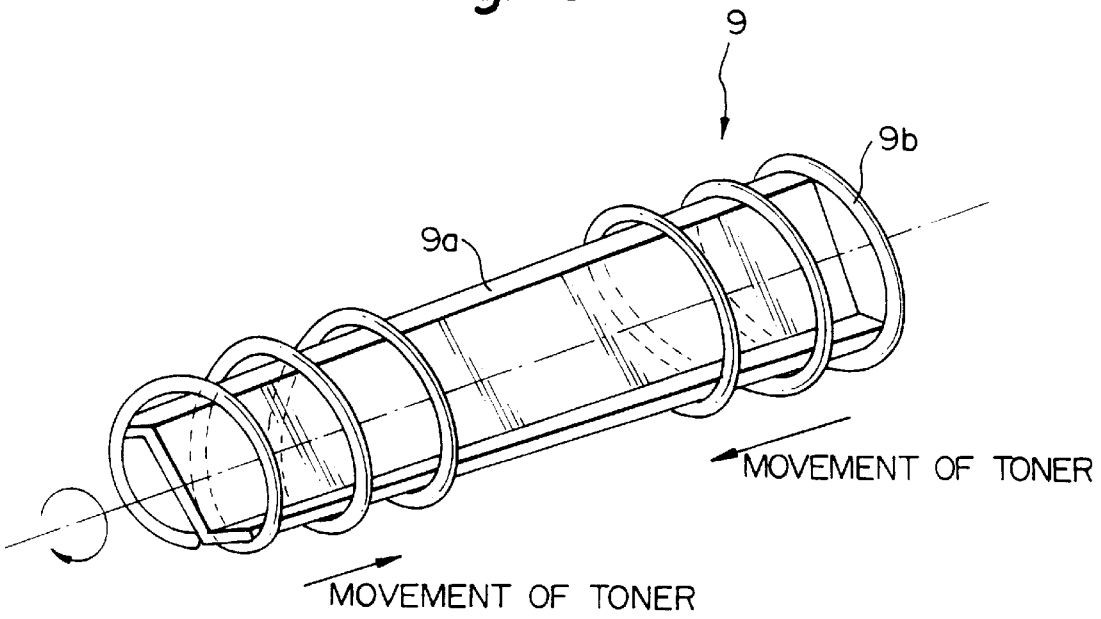
FIG. 10 is a perspective view of the agitator shown in FIG. 9.

Referring to FIGS. 9 and 10, an agitator representative of an alternative embodiment of the present invention is shown. As shown, the agitator, generally 9, has a supply roller 9*a* implemented by a sheet metal having bent portions at opposite edges thereof. An auger 9*b* is implemented as two coil members respectively wound round opposite ends of the roller 9*a*. The agitator 9 is rotatable about the longitudinal axis thereof. The bent portions of the roller 9*a* are oriented counter to the direction of rotation of the roller 9*a*. The coil members of the auger 9*b* are spirally wound round the roller 9*a* from the ends of the roller 9*a* toward the center in the same direction as the direction of rotation of the roller 9*a*. This embodiment differs from the previous embodiment in that the coil members constituting the auger 9*b* are wound round the opposite ends of the agitator 9.

When the agitator 9 shown in FIGS. 9 and 10 is rotated, it sequentially shifts the toner from the opposite ends toward the center. Hence, the toner density is prevented from decreasing at the end portions of the developing device 25. In addition, the amount of toner increases at the intermediate portion of the hopper 8 and can enter the toner outlets 27 in a great amount.

Generally, a toner is apt to cohere and form blocks when temperature around a developing device rises. This is also true when humidity around the developing device rises. When the developing device is operated under such conditions, the toner adheres to a supply roller in a hopper such that the roller turns out a rod. If the developing device is further operated with the toner sequentially adhering thereto, the toner further solidifies due to the temperature or the humidity, aggravating the configuration of the supply roller. When the supply roller rotating at a high speed turns out a rod, it cannot seize the toner existing therearound. As a result, a space is formed between the supply roller and the neighborhood thereof. In this condition, the supply roller looses its function, and so does an auger. Consequently, the supply roller fails to shift the toner toward the center thereof.

Figure 11:
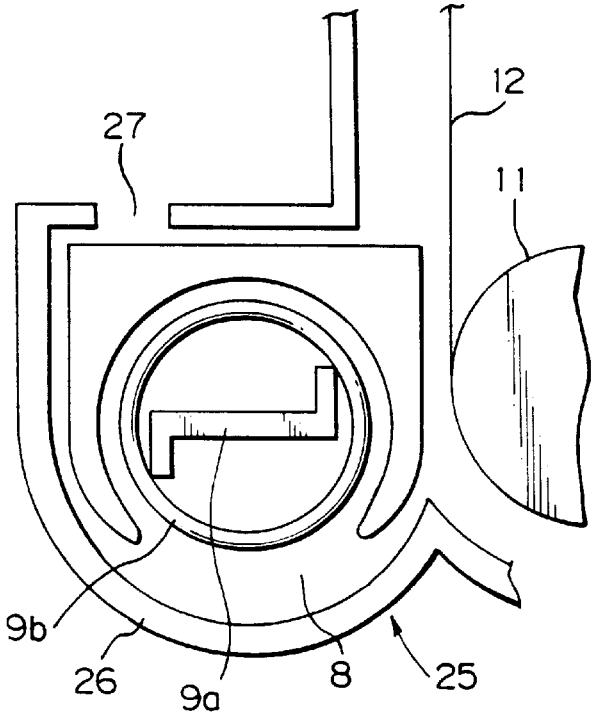
FIG. 11 is a side elevation showing how a toner adheres to a supply roller.

FIG. 11 is a section view showing the supply roller turning out a rod due to the adhesion of the toner. As shown, a space is formed between the supply roller 9*a* and its neighborhood and causes the roller 9*a* to loose its expected function. Particularly, the portions of the roller 9*a* where the auger 9*b* is provided turn out a rod earlier than the other portion because the toner easily adheres to the auger 9*b*.

Figure 12:
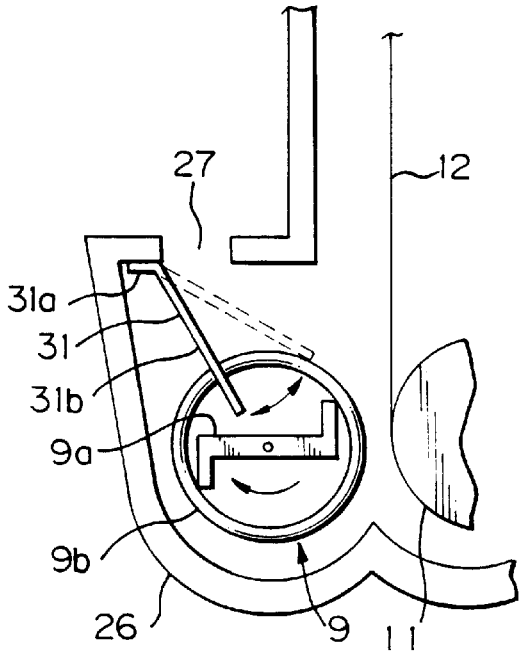
FIG. 12 is a side elevation showing an agitator representative of another alternative embodiment of the present invention, together with an arrangement around the agitator.
Figure 13:
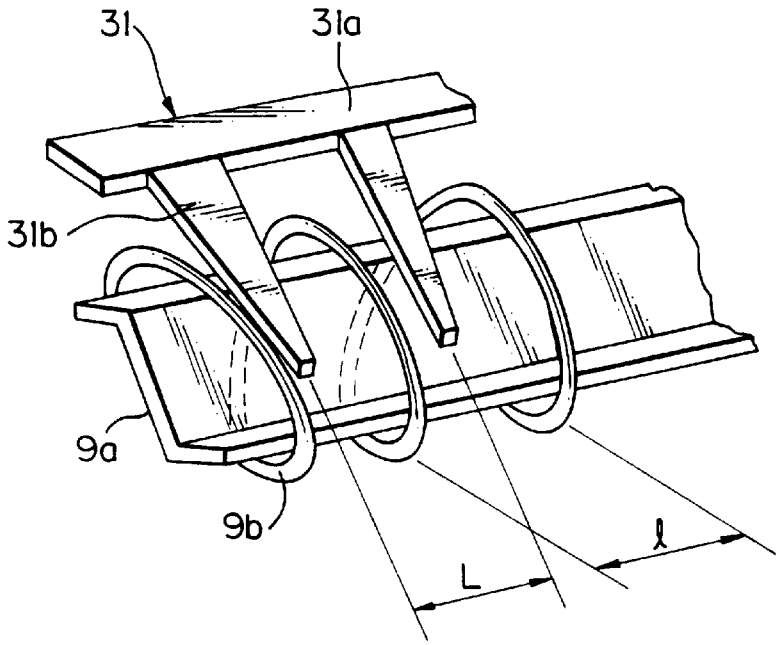
FIG. 13 is a perspective view of the agitator shown in FIG. 12 and an arrangement adjoining it.

Referring to FIGS. 12 and 13, an arrangement around an agitator and representative of another alternative embodiment of the present invention will be described. As shown, an agitator film 31 is affixed to the casing 26 at its portion 31*a* in the vicinity of the toner outlets 27. A plurality of flexible teeth 31*b* extend out from the portion 31*a* like the teeth of a comb. The tips of the teeth 31*b* are each positioned between the nearby turns of the auger 9*b* and adjoins the supply roller 9*a*. The auger 9*b* is provided with a constant pitch l. The flexible teeth 31*b* of the film 31 are provided with a pitch L equal to the pitch l of the auger 9*b*. As shown in FIG. 12, when the roller 9*a* is rotated, the teeth 31*b* are raised by the roller 9*a* or the auger 9*b* and then lowered due to their flexibility.

With the above configuration, it is possible to agitate the toner existing between the turns of the auger 9*b* and to thereby prevent it from adhering to the roller 9*a* and auger 9*b*.

Figure 14:
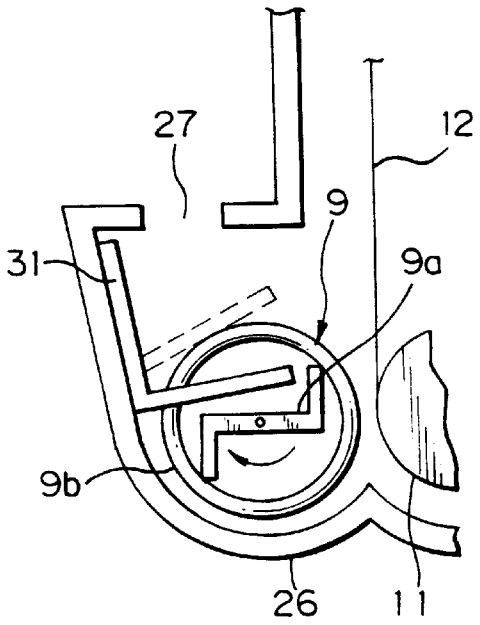
FIG. 14 is a side elevation of another specific configuration of the agitator.

While the agitator film 31 has been shown and described as being affixed to the vicinity of the toner outlets 27, they may be affixed to the inner periphery of the hopper 8, as shown in FIG. 14. The crux is that the tips of the flexible teeth 31*b* be received in the auger 9*b*.

Figure 15:
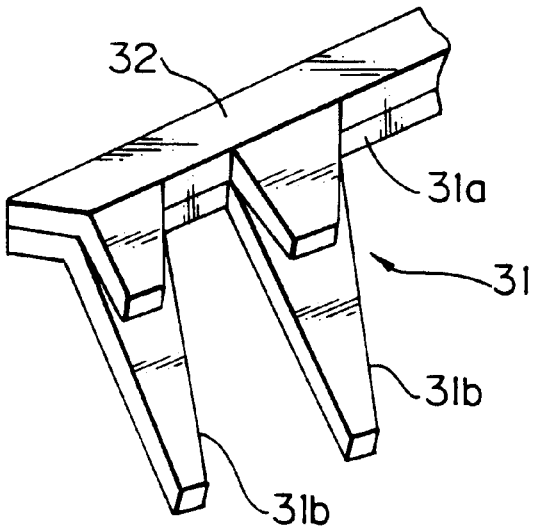
FIGS. 15 and 16 are perspective views each showing a particular configuration of an anti-deformation sheet metal attached to an agitator film.
Figure 16:
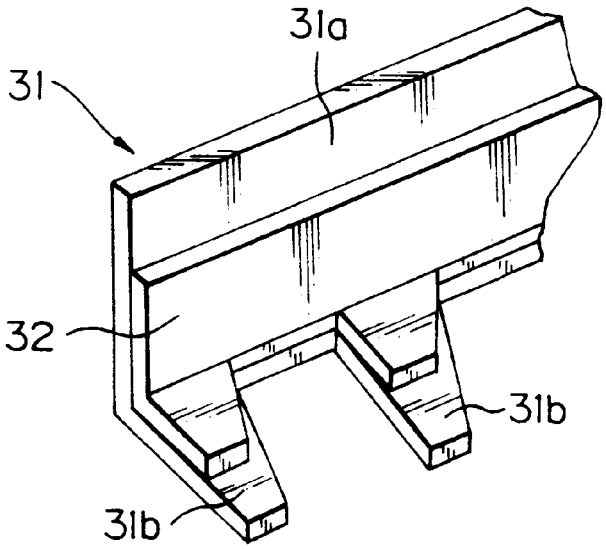

The agitator film 31 shown in FIG. 12 or 14 is likely to loose its flexibility due to aging and fail to return to the original position, i.e., to deform permanently. FIGS. 15 and 16 respectively show sheet metals 32 which may be used to prevent the films 31 shown in FIGS. 12 and 14 from bending. As shown, the sheet metals 32 of FIGS. 15 and 16 are respectively affixed to the films 31 of FIGS. 12 and 14. The sheet metals 32 each have a comb-like configuration for covering the affixing portion 31*a* of the film 31 and a part of the root portions of the teeth 31*b*.

In any of the embodiments shown and described, the toner is circulated between the cartridge 20 and the hopper 8, so that the additive of the toner existing in the developing device 25 is scattered. This prevents the additive from staying at limited portions and thereby insures stable images. Particularly, the coil members 9*b* attached to the opposite ends of the agitator 9, as shown in FIG. 10, promote the circulation of the toner and allow the toner to be rapidly fed from the end portions of the developing device 25.

Because the edges of the toner outlets 29 and toner inlets 30 and the edges of the collection openings 24 and toner outlets 27 are flared, the toner is allowed to move smoothly between the cartridge 20 and the hopper 8. The sponge 28 has both a sealing function and a guiding function. This, coupled with the fact that the walls of the openings 24 and 27 smoothly merge into each other without any step, prevents the toner from flowing reversely or from flying about, thereby further enhancing the smooth circulation of the toner.

The teeth 31*b* of the agitator film 31 positioned between the turns of the auger 9*b*, as shown in FIG. 12 or 14, agitate the toner existing there and thereby prevent it from adhering to the supply roller 9*a* and auger 9*b*. Hence, when the supply roller 9*a* is rotated, the auger 9*b* forcibly and stably shifts the toner from the end portions of the developing device 25 toward the center. As a result, the amount of toner increases at the intermediate portion of the hopper 8 and enters the toner outlets 27 in a great amount. This promotes the circulation of the toner and allows the toner to be rapidly fed from the end portions of the hopper 8.

In summary, it will be seen that the present invention provides a developing device for an image forming apparatus and a toner cartridge having various unprecedented advantages, as enumerated below.

(1) A toner is circulated between a toner cartridge and a hopper so that the additive of the toner existing in a developing device is scattered. This prevents the additive from staying at limited portions and thereby insures stable images.

(2) Toner outlets and collection openings formed in the cartridge may be provided a suitable arrangement, so that a path for the circulation of the toner may also be suitably arranged.

(3) The toner can be collected in the cartridge by simple means.

(4) Because the toner is replenished and collected by a magnetic roller, it is not necessary to provide the cartridge with an extra space for toner collecting means. Hence, the toner circulation is achievable with a minimum of cost.

(5) The toner is fed from opposite end portions of the hopper and then collected at the center. Hence, the toner whose additive concentration is apt to increase at the end portions of the hopper is efficiently scattered. This promotes the smooth circulation of the toner and thereby insures stable development.

(6) The movement of the hopper to the cartridge is smooth.

(7) During the circulation of the toner, the toner is prevented from dropping via gaps between the cartridge and the developing device.

(8) The cartridge has a toner replenishing function and a toner collecting function. This allows the toner to be circulated between the cartridge and the hopper. As a result, the additive included in the toner is prevented from staying in limited portions; otherwise the toner density would be lowered in the limited portions.

(9) Because a movable member is received between the turns of a coil member, the toner is prevented from cohering around the coil member. Hence, the toner is replenished and agitated in a stable manner.

(10) Because the toner is circulated between the cartridge and the hopper, the additive of the toner is prevented from staying in limited portions; otherwise the toner density would be lowered in the limited portions. The coil member surrounding a supply roller and the movable member received between the turns of the coil member achieve the above advantage (9), and further enhances the circulation of the toner.

(11) Because the coil member and the movable member have the same pitch, the toner can be efficiently agitated.

(12) A film member used as the movable member is inexpensive and can be freely designed.

(13) An anti-deformation member is associated with the film member and insures stable toner agitation and replenishment despite aging. Hence, a stable image is attainable at all times.

Various modifications will become possible for those skilled in the art after receiving the present disclosure without departing from the scope thereof. For example, the number of toner outlets and that of the collection openings of the cartridge shown and described are only illustrative. However, because the toner is replenished by being dropped and is collected by being raised, it is preferable that the number of the collection openings be equal to or greater than the number of the toner outlets.

Further, the arrangement of the toner outlets and collection openings of the cartridge and the arrangement of the blade and ribs shown and described are also only illustrative. However, because the additive concentration of the toner tends to increase at the end portions of the hopper 8 so long as the developing device is horizontal, it is preferable to feed the toner from the end portions of the hopper 8 toward the center and then collect it, as in the embodiments.

The agitator film may be replaced with a sheet metal, if desired. The crux is that portions corresponding to the flexible teeth be movable. Of course, the triangular teeth shown in FIG. 13 may be modified in various ways, e.g., they may be provided with holes or curved portions.

What is claimed is:

1. A toner cartridge removably mounted to an image forming apparatus including a developing device, comprising:

a plurality of toner outlet openings for replenishing toner to the developing device; and a plurality of toner collection openings for collecting the toner from the developing device;

wherein said plurality of toner outlet openings and said plurality of toner collection openings are arranged substantially in a single array.

2. A toner cartridge as claimed in claim 1, wherein said plurality of toner outlet openings are arranged outside of said plurality of toner collection openings.

3. A toner cartridge as claimed in claim 1, further comprising a magnetic roller facing said plurality of toner outlet openings and said plurality of toner collection openings, wherein said magnetic roller attracts and circulates the toner.

4. A toner cartridge as claimed in claim 3, further comprising a protruding portion located downstream of said plurality of toner outlet openings in a direction of rotation of said magnetic roller, wherein said protruding portion scrapes off the toner deposited on said magnetic roller into said plurality of toner outlet openings.

5. A toner cartridge as claimed in claim 4, wherein an end of said protruding portion and said magnetic roller are spaced from each other at a preselected distance.

6. A toner cartridge as claimed in claim 3, further comprising a blade contacting said magnetic roller, wherein said blade scrapes off the toner deposited on said magnetic roller into said toner cartridge.

7. A toner cartridge as claimed in claim 6, wherein said blade contacts a portion of said magnetic roller facing said plurality of toner collection openings.

8. A toner cartridge removably mounted to an image forming apparatus including a developing device, comprising:

a plurality of toner outlet openings for replenishing toner to the developing device;

a plurality of toner collection openings for collecting the toner from the developing device;

a magnetic roller facing said plurality of toner outlet openings and said plurality of toner collection openings, wherein said magnetic roller attracts the toner;

a protruding portion for scraping off the toner deposited on said magnetic roller into said plurality of toner outlet openings; and a blade for scraping off the toner collected from the developing device via said plurality of toner collection openings and deposited on said magnetic roller into said toner cartridge.

9. A toner cartridge as claimed in claim 8, wherein said blade contacts a portion of said magnetic roller facing said plurality of toner collection openings.

10. A toner cartridge as claimed in claim 9, wherein said protruding portion faces a portion of said magnetic roller not contacting said blade.

11. A toner cartridge as claimed in claim 9, wherein said magnetic roller and said blade contact each other at a position downstream of said protruding portion in a direction of rotation of said magnetic roller.

12. A toner cartridge as claimed in claim 8, wherein an end of said protruding portion and said magnetic roller are spaced from each other at a preselected distance.

13. A toner cartridge as claimed in claim 8, wherein said protruding portion is located downstream of said plurality of toner outlet openings in a direction of rotation of said magnetic roller.

14. A toner cartridge as claimed in claim 8, wherein said plurality of toner outlet openings and said plurality of toner collection openings are arranged substantially in a single array.

15. A toner cartridge as claimed in claim 14, wherein said plurality of toner outlet openings are arranged outside of said plurality of toner collection openings.

16. A toner cartridge removably mounted to an image forming apparatus including a developing device, comprising:

a plurality of toner outlet openings for replenishing toner to the developing device;

a plurality of toner collection openings for collecting the toner from the developing device;

a magnetic roller facing said plurality of toner outlet openings and said plurality of toner collection openings, wherein said magnetic roller attracts the toner;

a protruding portion located downstream of said plurality of toner outlet openings in a direction of rotation of said magnetic roller, wherein said protruding portion scrapes off the toner deposited on said magnetic roller into said plurality of toner outlet openings; and a blade contacting a portion of said magnetic roller facing said plurality of toner outlet openings, wherein said blade scrapes off the toner collected from the developing device via said plurality of toner collection openings and deposited on said magnetic roller into said toner cartridge.

17. A toner cartridge as claimed in claim 16, wherein said protruding portion faces a portion of said magnetic roller not contacting said blade.

18. A toner cartridge as claimed in claim 16, wherein said magnetic roller and said blade contact each other at a position downstream of said protruding portion in a direction of rotation of said magnetic roller.

19. A toner cartridge as claimed in claim 16, wherein an end of said protruding portion and said magnetic roller are spaced from each other at a preselected distance.

20. A toner cartridge as claimed in claim 16, wherein said plurality of toner outlet openings and said plurality of toner collection openings are arranged substantially in a single array.

21. A toner cartridge as claimed in claim 20, wherein said plurality of toner outlet openings are arranged outside of said plurality of toner collection openings.

22. A toner cartridge removably mounted to an image forming apparatus including a developing device, comprising:

means for replenishing toner to the developing device; and means for collecting the toner from the developing device;

wherein said toner replenishing means and said toner collecting means are arranged substantially in a single array.

23. A toner cartridge as claimed in claim 22, wherein said toner replenishing means is arranged outside of said toner collecting means.

24. A toner cartridge as claimed in claim 22, further comprising magnetic roller means for attracting and circulating the toner, wherein said toner attracting and circulating means faces said toner replenishing means and said toner collecting means.

25. A toner cartridge as claimed in claim 24, further comprising first scraping means for scraping off the toner deposited on said toner attracting and circulating means into said toner replenishing means, wherein said first scraping means is located downstream of said toner replenishing means in a direction of rotation of said toner attracting and circulating means.

26. A toner cartridge as claimed in claim 25, wherein an end of said first scraping means and said toner attracting and circulating means are spaced from each other at a preselected distance.

27. A toner cartridge as claimed in claim 24, further comprising a second scraping means contacting said toner attracting and circulating means, wherein said second scraping means scrapes the toner deposited on said toner attracting and circulating means into said toner cartridge.

28. A toner cartridge as claimed in claim 27, wherein said second scraping means contacts a portion of said toner attracting and circulating means facing said toner replenishing means.

29. A toner cartridge removably mounted to an image forming apparatus including a developing device, comprising:

means for replenishing toner to the developing device;

means for collecting the toner from the developing device;

magnetic roller means for attracting and circulating the toner, wherein said toner attracting and circulating means faces said toner replenishing means and said toner collecting means;

first scraping means for scraping off toner deposited on said toner attracting and circulating means into said toner replenishing means; and second scraping means for scraping toner collected from the developing device via said toner replenishing means and deposited on said toner attracting and circulating means into said toner cartridge.

30. A toner cartridge as claimed in claim 29, wherein said second scraping means contacts a portion of said toner attracting and circulating means facing said toner replenishing means.

31. A toner cartridge as claimed in claim 30, wherein said first scraping means faces a portion of said toner attracting and circulating means not contacting said second scraping means.

32. A toner cartridge as claimed in claim 31, wherein said toner attracting and circulating means and said second scraping means contact each other at a position downstream of said first scraping means in a direction of rotation of said toner attracting and circulating means.

33. A toner cartridge as claimed in claim 29, wherein an end of said first scraping means and said toner attracting and circulating means are spaced from each other at a preselected distance.

34. A toner cartridge as claimed in claim 29, wherein said first scraping means is located downstream of said toner replenishing means in a direction of rotation of said toner attracting and circulating means.

35. A toner cartridge as claimed in claim 29, wherein said toner replenishing means and said toner collecting means are arranged substantially in a single array.

36. A toner cartridge as claimed in claim 35, wherein said toner replenishing means is arranged outside of said toner collecting means.

37. A toner cartridge removably mounted to an image forming apparatus including a developing device, comprising:

means for replenishing toner to the developing device;

means for collecting the toner from the developing device;

magnetic roller means for attracting and circulating the toner, wherein said toner attracting and circulating means faces said toner replenishing means and said toner collecting means;

first scraping means located downstream of said toner replenishing means in a direction of rotation of said toner attracting and circulating means, wherein said first scraping means scrapes off the toner deposited on said toner attracting and circulating means into said toner replenishing means; and second scraping means contacting a portion of said toner attracting and circulating means facing said toner replenishing means, wherein said second scraping means scrapes off the toner collected from the developing device via said toner collecting means and deposited on said toner attracting and circulating means into said toner cartridge.

38. A toner cartridge as claimed in claim 37, wherein said first scraping means faces a portion of said toner attracting and circulating means not contacting said second scraping means.

39. A toner cartridge as claimed in claim 37, wherein said toner attracting and circulating means and said second scraping means contact each other at a position downstream of said first scraping means in a direction of rotation of said toner attracting and circulating means.

40. A toner cartridge as claimed in claim 37, wherein an end of said first scraping means and said toner attracting and circulating means are spaced from each other by a preselected distance.

41. A toner cartridge as claimed in claim 37, wherein said toner replenishing means and said toner collecting means are arranged substantially in a single array.

42. A toner cartridge as claimed in claim 41, wherein said toner replenishing means is arranged outside of said toner collecting means.

43. A method for conveying toner from a toner cartridge removably mounted to an image forming apparatus including a developing device, comprising the steps of:

replenishing toner to the developing device by a plurality of toner outlet openings; and collecting the toner from the developing device by a plurality of toner collection openings;

wherein said step of replenishing comprises replenishing toner by said plurality of toner outlet openings, said plurality of toner outlet openings being arranged substantially in a single array with said plurality of toner collection openings.

44. A method for conveying toner as claimed in claim 43, wherein said step of replenishing further comprises replenishing toner through said plurality of toner outlet openings, said plurality of toner outlet openings being arranged outside of said plurality of toner collection openings.

45. A method for conveying toner as claimed in claim 43, further comprising the step of attracting and circulating the toner by a magnetic roller facing said plurality of toner outlet openings and said plurality of toner collection openings.

46. A method for conveying toner as claimed in claim 45, further comprising the step of scraping off the toner deposited on said magnetic roller into said plurality of toner outlet openings by a protruding portion located downstream of said plurality of toner outlet openings in a direction of rotation of said magnetic roller.

47. A method for conveying toner as claimed in claim 46, wherein said step of scraping toner further comprises scraping off the toner deposited on said magnetic roller into said plurality of toner outlet openings through said protruding portion, said protruding portion having an end spaced from said magnetic roller at a preselected distance.

48. A method for conveying toner claimed in claim 45, further comprising the step of scraping off the toner deposited on said magnetic roller into said toner cartridge by a blade contacting said magnetic roller.

49. A method for conveying toner as claimed in claim 48, wherein said step of scraping toner further comprises scraping off the toner deposited on said magnetic roller into said toner cartridge by said blade facing said plurality of toner collection openings.

50. A method for conveying toner from a toner cartridge removably mounted to an image forming apparatus including a developing device, comprising the steps of:

replenishing toner to the developing device by a plurality of toner outlet openings;

collecting the toner from the developing device by a plurality of toner collection openings;

attracting and circulating the toner by a magnetic roller facing said plurality of toner outlet openings and said plurality of toner collection openings;

scraping off the toner deposited on said magnetic roller into said plurality of toner outlet openings by a protruding portion; and scraping off the toner collected from the developing device via said plurality of toner collection openings and deposited on said magnetic roller into said toner cartridge by a blade.

51. A method for conveying toner as claimed in claim 50, wherein said step of scraping off the toner collected from the developing device via said plurality of toner collection openings and deposited on said magnetic roller into said toner cartridge by said blade further comprises contacting said blade to a portion of said magnetic roller facing said plurality of toner collection openings.

52. A method for conveying toner as claimed in claim 51, wherein said step of scraping off the toner deposited on said magnetic roller into said plurality of toner outlet opening by said protruding portion further comprises facing said protruding portion to a portion of said magnetic roller not contacting said blade.

53. A method for conveying toner as claimed in claim 51, wherein said attracting and circulating step further comprises attracting and circulating the toner by said magnetic roller contacting said blade at a position downstream of said protruding portion in a direction of rotation of said magnetic roller.

54. A toner cartridge as claimed in claim 50, wherein said step of scraping off the toner deposited on said magnetic roller into said plurality of toner outlet openings by said protruding portion further comprises spacing said protruding portion from said magnetic roller at a preselected distance.

55. A method for conveying toner as claimed in claim 50, wherein said step of scraping off the toner deposited on said magnetic roller into said plurality of toner outlet openings by said protruding portion further comprises locating said protruding portion downstream of said plurality of toner outlet openings in a direction of rotation of said magnetic roller.

56. A method for conveying toner as claimed in claim 50, wherein said step of replenishing toner to the developing device by said plurality of toner outlet openings further comprises arranging said plurality of toner outlet openings substantially in a single array with said plurality of toner collection openings.

57. A method for conveying toner as claimed in claim 56, wherein said step of replenishing toner to the developing device by said plurality of toner outlet openings further comprises arranging said plurality of toner outlet openings outside of said plurality of toner collection openings.

58. A method for conveying toner from a toner cartridge removably mounted to an image forming apparatus including a developing device, comprising the steps of:

replenishing toner to the developing device by a plurality of toner outlet openings;

collecting the toner from the developing device by a plurality of toner collection openings;

attracting and circulating the toner by a magnetic roller facing said plurality of toner collection openings;

scraping off the toner deposited on said magnetic roller into said plurality of toner outlet openings by a protruding portion further comprising locating said protruding portion downstream of said plurality of toner outlet openings in a direction of rotation of said magnetic roller; and scraping off the toner collected from the developing device via said plurality of toner collection openings and deposited on said magnetic roller into said toner cartridge by a blade further comprising said blade contacting a portion of said magnetic roller facing said plurality of toner outlet openings.

59. A method for conveying toner as claimed in claim 58, wherein said step of scraping off the toner deposited on said magnetic roller into said plurality of toner outlet openings by said protruding portion further comprises facing said protruding portion to a portion of said magnetic roller not contacting said blade.

60. A method for conveying toner as claimed in claim 58, wherein said attracting and circulating step further comprises attracting and circulating the toner by said magnetic roller contacting said blade at a position downstream of said protruding portion in a direction of rotation of said magnetic roller.

61. A method for conveying toner as claimed in claim 58, wherein said step of scraping off the toner deposited on said magnetic roller into said plurality of toner outlet openings by said protruding portion further comprises spacing said protruding portion from said magnetic roller by at a preselected distance.

62. A method for conveying toner as claimed in claim 58, wherein said step of replenishing toner to the developing device by said plurality of toner outlet openings further comprises arranging said plurality of toner outlet openings substantially in a single array with said plurality of toner collection openings.

63. A method for conveying toner as claimed in claim 60, wherein said step of replenishing toner to the developing device by said plurality of toner outlet openings further comprises arranging said plurality of toner outlet openings outside of said plurality of toner collection openings.

* * * * *

UNITED STATES PATENT AND TRADEMARK OFFICE

CERTIFICATE OF CORRECTION

PATENT NO. : 5,995,789

DATED : November 30, 1999

INVENTOR(S) : Eisaku MURAKAMI, et al.

It is certified that error appears in the above-identified patent and that said Letters Patent is hereby corrected as shown below:

On the title page, item [54], and at the top of column 1, the title should read:

-- [54] TONER CARTRIDGE REMOVABLY MOUNTED TO AN IMAGE FORMING APPARATUS AND INCLUDING TONER OUTLET OPENINGS AND TONER COLLECTION OPENINGS ARRANGED SUBSTANTIALLY IN A SINGLE ARRAY --

On the title page, item [30] should be:

--[30] Foreign Application Priority Data

Feb. 16, 1995 [JP] Japan ..... 7-028074
Mar. 23, 1995 [JP] Japan ..... 7-091856
Apr. 28, 1995 [JP] Japan ..... 7-106516 --

Signed and Sealed this

Thirtieth Day of January, 2001

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,995,789

DATED : November 30, 1999

INVENTOR(S) : Eisaku Murakami

It is certified that error appears in the above-indentified patent and that said Letters Patent is hereby corrected as shown below:

On the title page, item [30] should be:

--[30] Foreign Application Priority Data

Feb. 16, 1995 [JP] Japan ..... 7-028074
Mar. 23, 1995 [JP] Japan ..... 7-091856
Apr. 28, 1995 [JP] Japan ..... 7-106516 --

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*